US008744252B1

(12) United States Patent
Snyder et al.

(10) Patent No.: US 8,744,252 B1
(45) Date of Patent: Jun. 3, 2014

(54) TANKLESS HOT WATER GENERATOR

(76) Inventors: John Snyder, Oldsmar, FL (US); Hoang Mai, Oldsmar, FL (US); Phillip B. Pham, Holiday, FL (US); Jennifer L. Pham, Holiday, FL (US)

( * ) Notice: Subject to any disclaimer, the term of this patent is extended or adjusted under 35 U.S.C. 154(b) by 1046 days.

(21) Appl. No.: 12/263,784

(22) Filed: Nov. 3, 2008

Related U.S. Application Data

(60) Provisional application No. 61/035,893, filed on Mar. 12, 2008.

(51) Int. Cl.
*F24H 1/10* (2006.01)

(52) U.S. Cl.
USPC ..... 392/482; 392/465; 392/479

(58) Field of Classification Search
USPC ..... 392/479, 482
See application file for complete search history.

(56) References Cited

U.S. PATENT DOCUMENTS

| | | | | | |
|---|---|---|---|---|---|
| 738,607 | A | * | 9/1903 | Ewart | 392/479 |
| 1,294,695 | A | * | 2/1919 | Osterheld | 392/482 |
| 1,355,838 | A | * | 10/1920 | McLean | 392/479 |
| 1,607,509 | A | * | 11/1926 | Boucher et al. | 392/482 |
| 1,672,942 | A | * | 6/1928 | Isaacs | 392/482 |
| 2,391,207 | A | * | 12/1945 | Van Schaack | 392/354 |
| 2,419,429 | A | * | 4/1947 | Voiles | 392/486 |
| 2,775,683 | A | * | 12/1956 | Kleist | 392/398 |
| 4,145,601 | A | * | 3/1979 | Lavrentiev et al. | 392/480 |
| 4,334,141 | A | * | 6/1982 | Roller et al. | 392/467 |
| 4,436,983 | A | * | 3/1984 | Solobay | 392/490 |
| 4,567,350 | A | * | 1/1986 | Todd Jr. | 392/486 |
| 4,604,515 | A | * | 8/1986 | Davidson | 392/492 |
| 4,762,980 | A | | 8/1988 | Insley | |
| 4,825,043 | A | * | 4/1989 | Knauss | 392/482 |
| 4,960,976 | A | | 10/1990 | Insley | |
| 5,138,693 | A | * | 8/1992 | Knauss | 392/445 |
| 5,216,743 | A | | 6/1993 | Seitz | |
| 5,223,696 | A | * | 6/1993 | Violi | 219/401 |
| 5,325,822 | A | | 7/1994 | Fernandez | |
| 5,371,830 | A | | 12/1994 | Wachenheim | |
| 5,408,578 | A | * | 4/1995 | Bolivar | 392/490 |
| 5,724,478 | A | * | 3/1998 | Thweatt | 392/484 |
| 5,866,880 | A | | 2/1999 | Seitz et al. | |
| 6,080,971 | A | | 6/2000 | Seitz et al. | |
| 6,246,831 | B1 | | 6/2001 | Seitz et al. | |
| 6,389,226 | B1 | | 5/2002 | Neale et al. | |
| 6,701,069 | B1 | * | 3/2004 | Cezayirli et al. | 392/490 |
| 7,088,915 | B1 | | 8/2006 | Sturm et al. | |
| 7,164,851 | B2 | | 1/2007 | Sturm et al. | |
| 7,190,894 | B2 | | 3/2007 | Chamberlain, Jr. | |
| 7,206,506 | B2 | * | 4/2007 | Sturm | 392/478 |
| 7,477,836 | B2 | * | 1/2009 | White, III | 392/465 |

* cited by examiner

*Primary Examiner* — Thor Campbell
(74) *Attorney, Agent, or Firm* — Ronald E. Smith; Courtney Dunn; Smith & Hopen, P.A.

(57) ABSTRACT

The invention includes a tankless liquid heater that employs a series of chambers, each having a plurality of heating tubes, with heating elements positioned thereon, and a control unit comprising a switch, controller, and power distributor to control the flow and heating of liquid in the system. In one embodiment, the control unit takes input from a liquid flow sensor that monitors the passage of liquid through the system, a temperature sensor adapted to monitor liquid temperature, and a current leakage sensor adapted to monitor the current leakage in the system. In response to these sensors, the control controller actuates the relay between an closed position, which allows current from the power distributor to pass to a plurality of heating elements, and an open position, which prevents the current from flowing from the power distributer to the plurality of heating elements.

9 Claims, 10 Drawing Sheets

TANKLESS HOT WATER GENERATOR

CROSS REFERENCE TO RELATED APPLICATIONS

This application claims priority to currently pending U.S. Provisional Patent Application 61/035,893, entitled, "Tankless Liquid Heater", filed Mar. 12, 2008.

BACKGROUND OF THE INVENTION

Electric flow-through liquid heaters, which are often described as electric tankless liquid heaters, heat liquids as they pass through the heat exchanger. The objective of such heaters is to heat liquid as it enters and passes through the heat exchanger to the desired set point by the time it is dispensed at the outlet of the heater. In concept, this process is relatively simple to achieve in closed loop systems in which the operating parameters for flow and temperature can be predetermined. Instantaneous and tankless hot liquid heaters are known in the art for the delivery of hot liquid at a point of use.

U.S. Pat. No. 3,909,588 issued to Walker et al. discloses an electric liquid heater using electrodes immersed in an electrically-insulated flow-through tank with controls sensing both liquid temperature and heating electrode current.

U.S. Pat. No. 4,337,388 issued to July discloses a rapid-response liquid heating and delivery system incorporating liquid heating means, liquid temperature sensing means, and proportional integral derivative (PID) method of closed loop control.

U.S. Pat. No. 4,638,147 issued to Dytch et al. discloses a microprocessor controlled flow-through liquid heater regulating heating power by switching combinations of heating elements of different wattages.

U.S. Pat. No. 4,829,159 issued to Braun et al. discloses a method of switching electrical heating elements loads to reduce switching transients by energizing all loads neither switched off nor full on in sequence.

U.S. Pat. No. 4,920,252 issued to Yoshino discloses a temperature control method for a plurality of heating elements by allocating a required actuating time within one cycle of a predetermined length of time.

U.S. Pat. No. 5,216,743 issued to Seitz discloses a thermoplastic heat exchanger for a flow-through instantaneous liquid heater including a control system using temperature comparisons.

U.S. Pat. No. 5,479,558 issued to White, Jr. et al. discloses a flow-through tankless liquid heater with a flow-responsive control means.

U.S. Pat. No. 5,504,306 issued to Russell et al. discloses a tankless liquid heater system incorporating a microprocessor based control sensing liquid outlet temperature, accepting an option remote temperature-setting means and providing control of heating elements by applying power in fractions of a power line cycle.

U.S. Pat. No. 5,866,880 issued to Seitz et al. discloses using a plurality of heating elements wherein each of the elements receives a substantially equal amount of power and the delay between each element being powered is no more than 32 half cycles.

SUMMARY OF INVENTION

The invention includes a tankless liquid heater that employs a series of chambers, each having a plurality of heating tubes, with heating elements positioned thereon, and a control unit comprising a switch, controller, and power distributor to control the flow and heating of liquid in the system.

The novel tankless water heater includes a first hollow chamber. A liquid inlet and a liquid outlet have respective first ends disposed externally of the first hollow chamber and respective second ends disposed internally of the first hollow chamber. At least one and preferably a plurality of straight tubes is disposed within the hollow chamber in parallel relation to one another. At least one curved tube has a return bend formed therein connecting contiguous parallel straight tubes to one another so that liquid fluid flowing through the straight tubes is constrained to reverse flow direction at least once. A first straight tube of the plurality of straight tubes has a leading end connected in fluid communication with the internal second end of the liquid inlet and a second straight tube of the plurality of tubes has a trailing end connected in fluid communication with the internal second end of the liquid outlet. An elongate insert is disposed concentrically within a lumen of each straight tube and a helical, radially outwardly extending flange is formed along a length of each elongate insert. A plurality of annular heating elements is disposed in contacting, circumscribing relation to each of the straight tubes and in longitudinally spaced apart relation to one another so that heat flows by conduction radially inwardly from the annular heating elements into the straight tubes, thereby heating the straight tubes. Each of the annular heating elements is in independent switched electrical communication with a remote source of electrical power so that loss of power to one annular heating element does not affect the other annular heating elements. Each of the annular heating elements is transversely disposed relative to a longitudinal axis of its associated straight tube. A source of unheated liquid fluid under pressure is connected in fluid communication with the external first end of the liquid inlet so that heated liquid fluid flows outwardly from the external first end of the liquid outlet when at least one of the annular heating elements is operating. The insert and the helical, radially outwardly extending flange causes liquid fluid to flow radially outwardly into contacting relation with the heated straight tubes. The liquid fluid does not contact the annular heating elements.

In a second embodiment, a second hollow chamber includes a liquid inlet and a liquid outlet having respective first ends disposed externally of the second hollow chamber and respective second ends disposed internally of the second hollow chamber. The second hollow chamber has a plurality of straight tubes disposed therewithin, interconnected to one another at alternating ends by a plurality of curved tubes having return bends formed therein so that liquid fluid flowing into the second hollow chamber at the liquid inlet of the second hollow chamber is constrained to reverse direction at least once before flowing out of the second hollow chamber at the liquid outlet of the second hollow chamber. To place the first and second hollow chambers in parallel relation to one another, a source of unheated liquid fluid under pressure is connected to respective external first ends of the liquid inlets of the first and second hollow chambers and heated liquid fluid flows from respective external first ends of the liquid outlets of the first and second hollow chambers. To place the first and second hollow chambers in series relation to one another, a source of unheated liquid fluid under pressure is connected to the external first end of the liquid inlet of the first hollow chamber and the external first end of the liquid outlet of the first hollow chamber is connected in fluid communication with the external first end of the liquid inlet of the second hollow chamber and the external first end of the liquid outlet of the second hollow chamber is in fluid communication with a point of use.

A temperature sensor and a flow sensor are coupled to the liquid heating assembly and a control module is in electrical communication with the temperature sensor and the flow sensor. The control module is programmed to control operating circuitry in response to electrical signals generated by the temperature sensor and flow sensor.

BRIEF DESCRIPTION OF THE DRAWINGS

For a fuller understanding of the invention, reference should be made to the following detailed description, taken in connection with the accompanying drawings, in which:

FIG. 4B is a view of the heating tubes of interior of the chambers of a tankless liquid heater in accordance with an embodiment of the present invention, showing the heating tubes and the liquid flow path there through.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
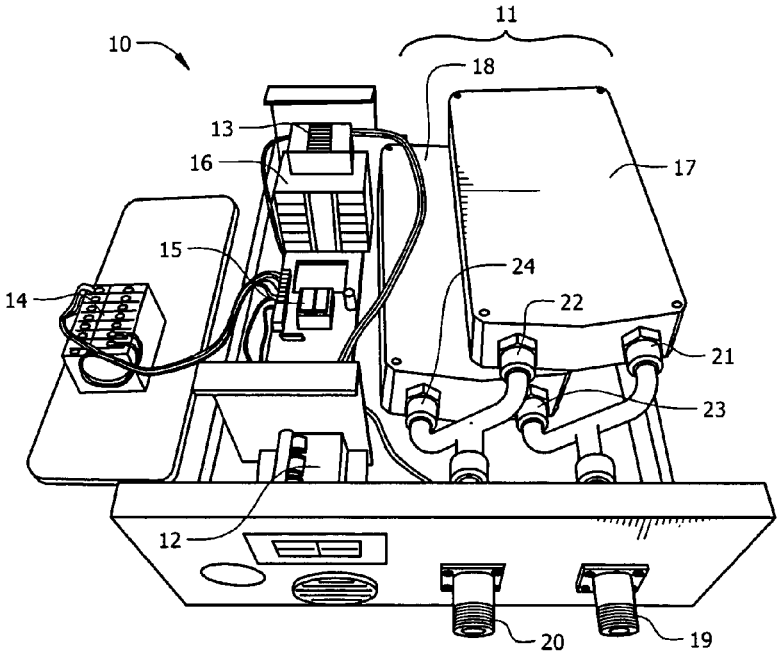
FIG. 1 is a perspective view of a tankless liquid heater in accordance with an embodiment of the present invention.

The components of a tankless liquid heater 10 of a first embodiment are shown in FIG. 1. As shown, tankless liquid heater 10 comprises liquid heating assembly 11, power distributer 12, switch/relay 13, temperature controller 14, general controller 15, heatsink, and a power source (not shown). Liquid heating assembly comprises first chamber 17, second chamber 18, primary liquid inlet 19 couple-able to a pressurized liquid source, and primary liquid outlet 20. First chamber 17 has liquid inlet 21 in liquid communication with primary liquid inlet 19 and liquid outlet 22 in liquid communication with primary liquid outlet 20. Second chamber 18 has liquid inlet 23 in liquid communication with primary liquid inlet 19 and liquid outlet 24 in liquid communication with primary liquid outlet 20. The dual chambers of the system shown in FIG. 1 create a redundant system. Systems with additional repetition or with only a single chamber are also contemplated. Multiple chambers can be stacked in parallel to increase liquid throughput.

Figure 2:
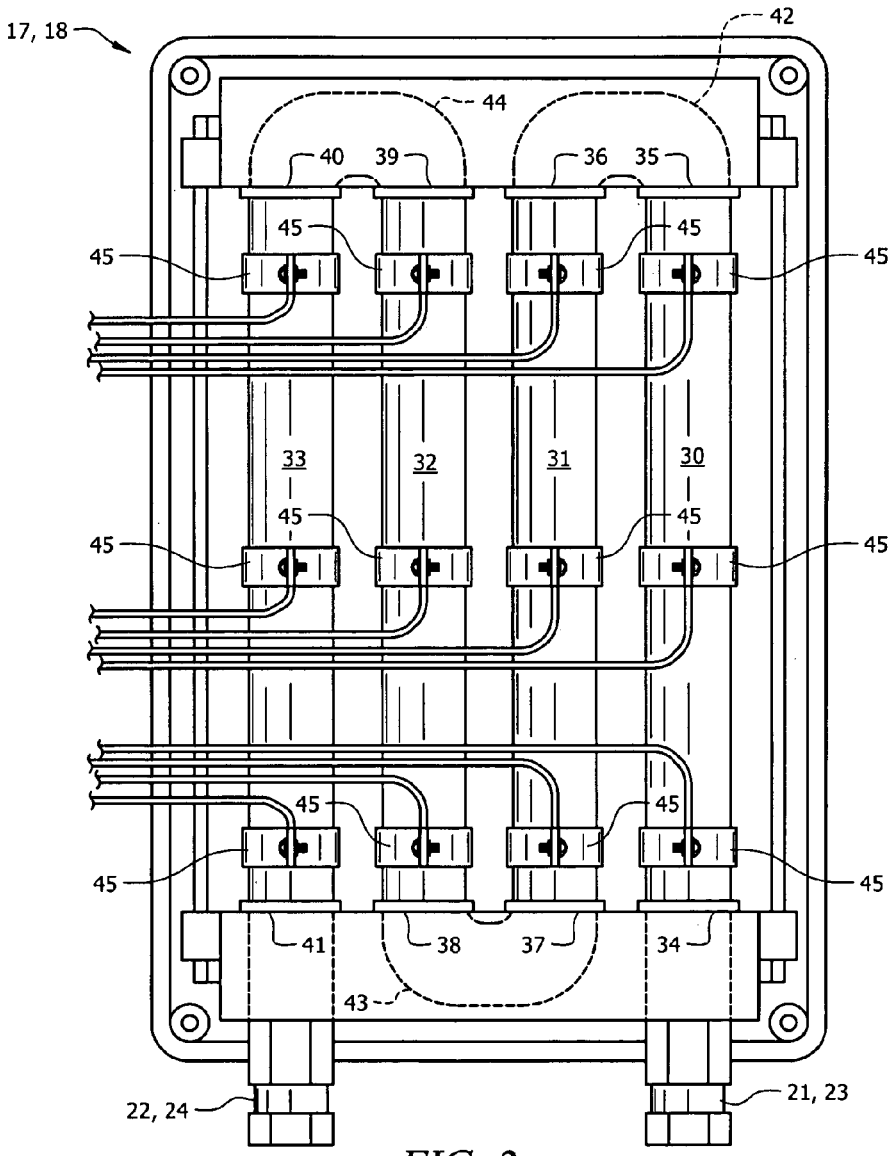
FIG. 2 is an exploded view of the heating tubes of the invention showing the plurality of heating elements disposed thereon.

FIG. 2 is an exploded view of the interior of first chamber 17 and second chamber 18. Chambers 17 and 18 each comprise liquid inlet 21,23, liquid outlet 22,24, first heating tube 30, second heating tube 31, third heating tube 32, and fourth heating tube 33. First heating tube 30 has inlet end 34 in liquid communication with the liquid inlet of chamber 17, 18 and outlet end 35. Second heating tube 31 has inlet end 36 in liquid communication with liquid outlet end 35 of first heating tube 30 and outlet end 37. Third heating tube 32 has inlet end 38 in liquid communication with liquid outlet end 37 of second heating tube 31 and outlet end 39. Fourth heating tube 33 has inlet end 40 in liquid communication with liquid outlet end 39 of third heating tube 32 and outlet end 41. Outlet end 35 of first heating tube 30 is connected to inlet end 36 of second heating tube 31 with first conduit 42 which forms a return bend as depicted. Outlet end 37 of second heating tube 31 is connected to inlet end 38 of third heating tube 32 with second conduit 43 which is also in the form of a return bend as depicted. Outlet end 39 of third heating tube 32 is connected to inlet end 40 of fourth heating tube 33 with third conduit 44, also of return bend configuration as depicted.

Heating tubes 30-33 may be made of any conductive material. In a preferred embodiment, heating tubes 30-33 are made of quartz. Chambers 17 and 18 may be increased or reduced in size and may contain any number of heating tubes.

Figure 3:
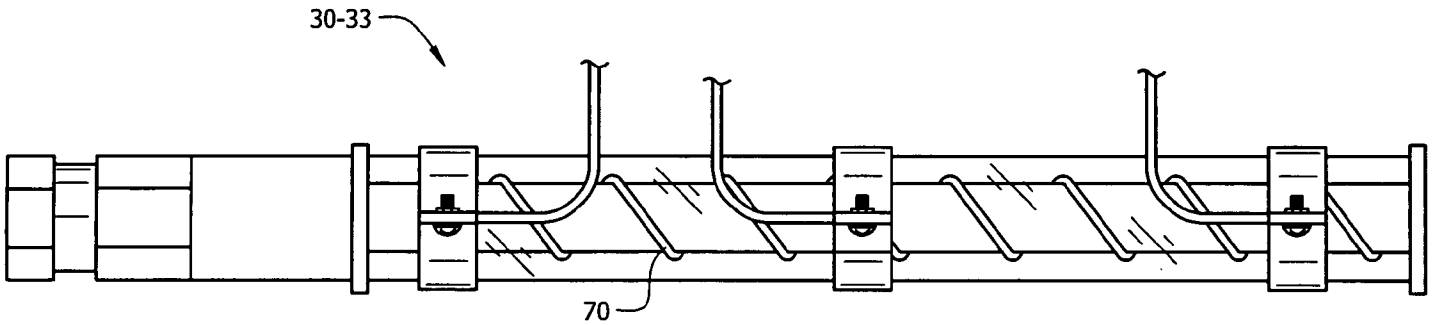
FIG. 3 is an exploded view of a heating tube showing the helical insert disposed therein in accordance with an embodiment of the present invention.

Each heating tube 30-33 includes insert 69 having raised helical ridge 70 formed integrally therewith as depicted in FIG. 3. Helical ridge 70 provides additional functionality by creating turbulence within the heating tube and thereby preventing mineral deposits from building up in the tube, and increasing the surface area of the liquid column that is exposed to the heating elements. Liquid fluid at the center of the column is forced into contact with the tube surface. As drawn, the diameter of insert 69 is about half the diameter of the lumen of its associated tube 30-33 so that the elongate toroid-shaped space 71 that surrounds insert 69 has a radial extent that is about half the radius of insert 69. Helical ridge 70 rises a short distance from insert 69 as depicted, and therefore extends into space 71 by only a nominal amount so that most of the gap between helical ridge 70 and the lumen of the tube is unoccupied. This nominal amount is sufficient to induce turbulence into the flow of liquid fluid through the heating tube in order to inhibit mineral deposit build-up. The relative dimensions as depicted and as recited herein are not critical; the only criticality is that helical ridge 70 be sufficiently prominent to induce turbulence but not so prominent as to promote unwanted laminar flow about insert 69. The term "nominal" means nominal relative to a distance from the elongate insert to an interior wall of the at least one straight tube within which said elongate insert is concentrically mounted.

At least one heating element 45 is positioned on each heating tube 30-33. For illustrative purposes, as shown in FIG. 2, heating elements 45 are placed at each end and at the center of heating tubes 30-33. However, any number and/or location of heating elements are contemplated by the present invention. The arrangement of heating elements at different positions on the tube allow for controlled heating of liquid at different locations within the tubes. This arrangement also provides a fine degree of control allowing the temperature of the liquid in the system to be changed by as little as 1 degree (higher or lower).

Figure 4A:
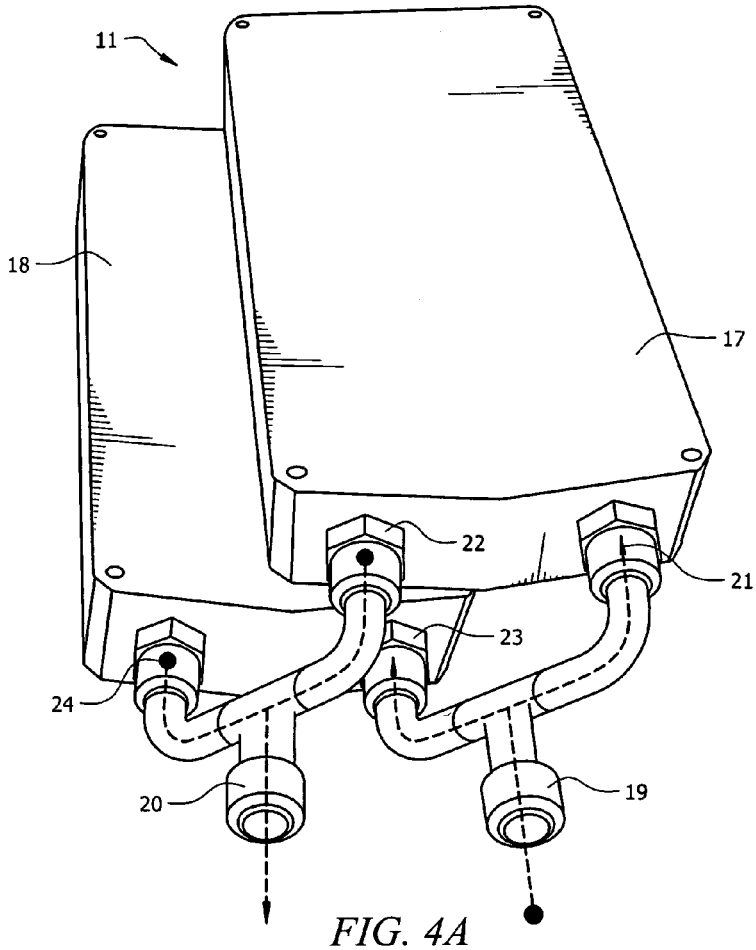
FIG. 4A is a exploded, perspective view of the liquid heating assembly in accordance with an embodiment of the present invention, showing the liquid flow path.
Figure 4B:
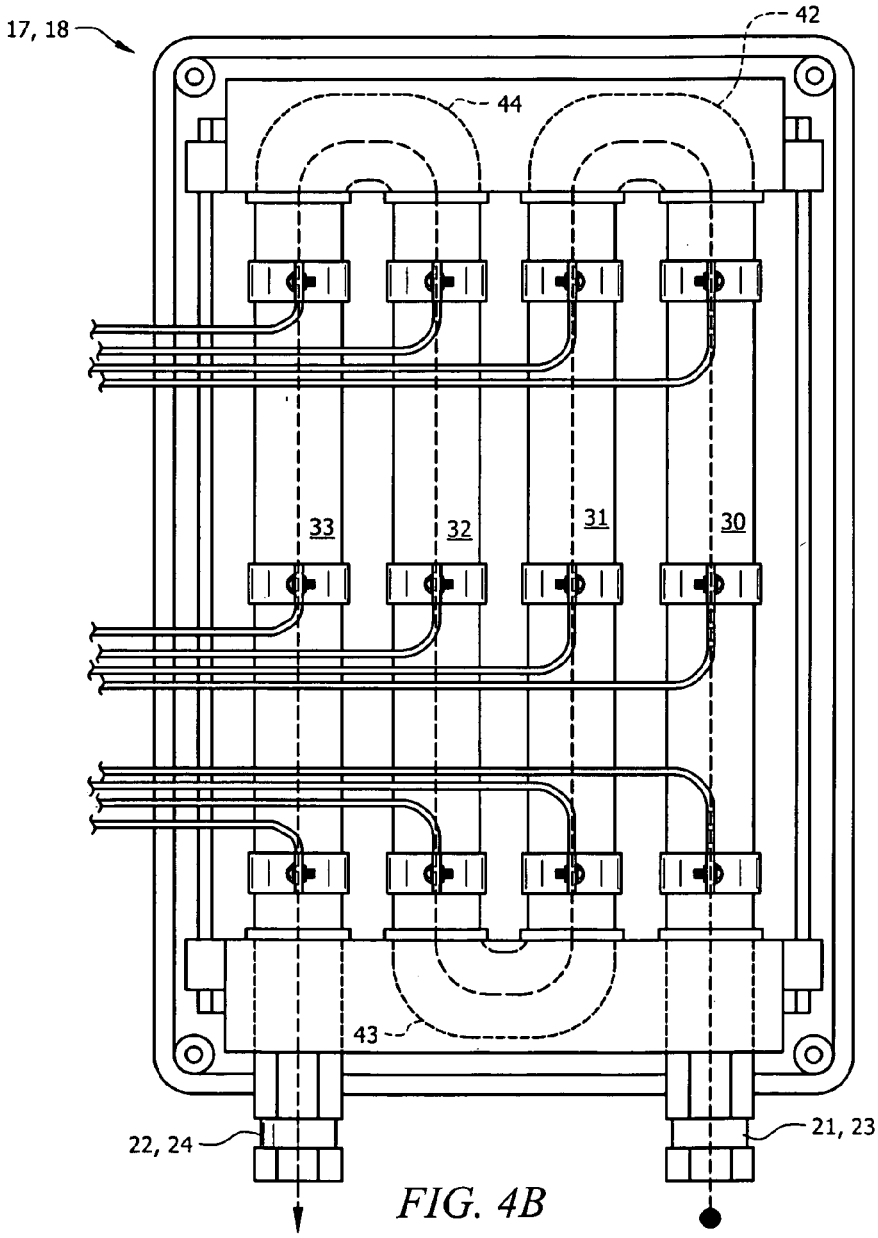

FIGS. 4A and 4B illustrates the liquid flow path through heating assembly 11 using dotted lines. Liquid enters at primary liquid inlet 19. Entering liquid is then split between liquid inlet 21 of first chamber 17 and liquid inlet 23 of second chamber 18. After entering each chamber 17,18, liquid passes through first heating tube 30, first conduit 42, second heating tube 31, second conduit 43, third heating tube 32, third conduit 44, and fourth heating tube, before passing out of chamber 17,18. Liquid exits first chamber 17 at liquid outlet 22 and exits second chamber 18 at liquid outlet 24. Liquid passing out of liquid outlet 22 and liquid outlet 24 combines and then exits through primary liquid outlet 20.

Figure 5:
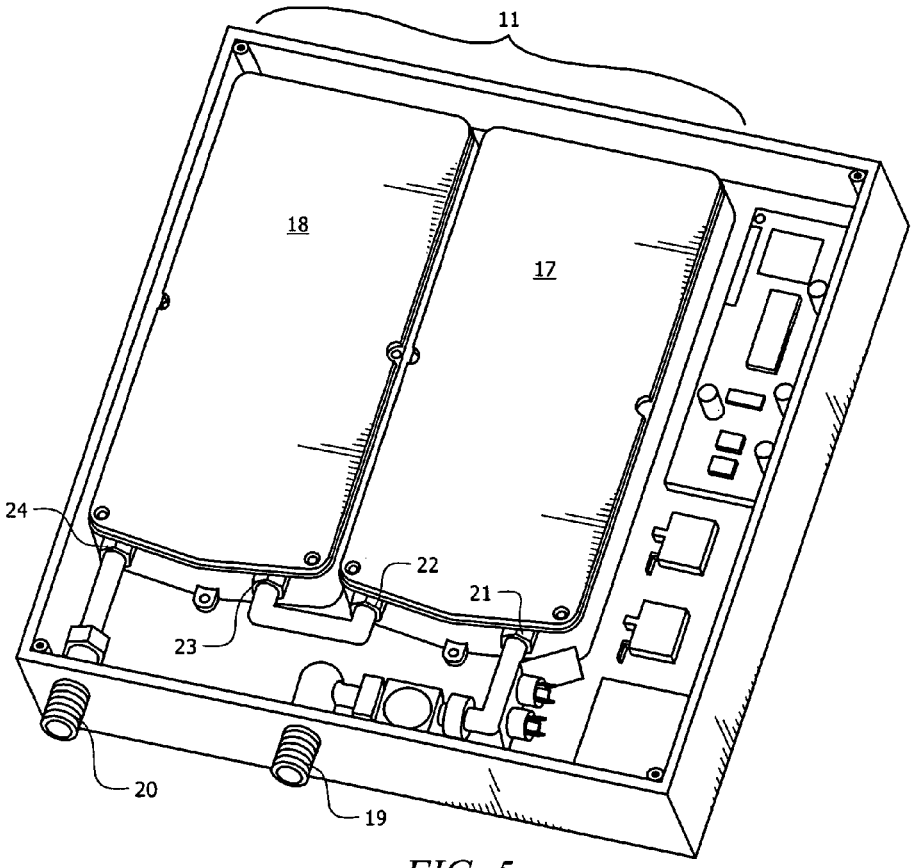
FIG. 5 is a perspective view of a tankless liquid heater in accordance with an embodiment of the present invention.

In another embodiment, as illustrated in FIG. 5, first chamber 17 and second chamber 18 are arranged in series. In this embodiment, primary liquid inlet 19 connects to first chamber 17 at liquid inlet 21, liquid outlet 22 of first chamber 17 connects to liquid inlet 23 of second chamber 18, and liquid outlet 24 of second chamber 18 connects to primary liquid outlet 20. The separation and re-combination of liquid is eliminated in this design. Once liquid enters through primary liquid inlet 19, it flows to liquid inlet 21 of first chamber 17. Once inside first chamber 17, liquid flows the same as described above and illustrated in FIG. 4B and then exits first chamber 17 at liquid outlet 22. Liquid then continues to liquid inlet 23 of second chamber 18. Once inside second chamber 18, liquid flows as described above and illustrated in FIG. 4B, exits second chamber 18 at liquid outlet 24, and continues to exit heating assembly 11 at primary liquid outlet 20. The dual chambers of the system shown in FIG. 5 create a repetitive system. Systems with additional repetition or with only single chamber are also contemplated. Multiple chambers can be added in series to increase liquid throughput.

Figure 6:
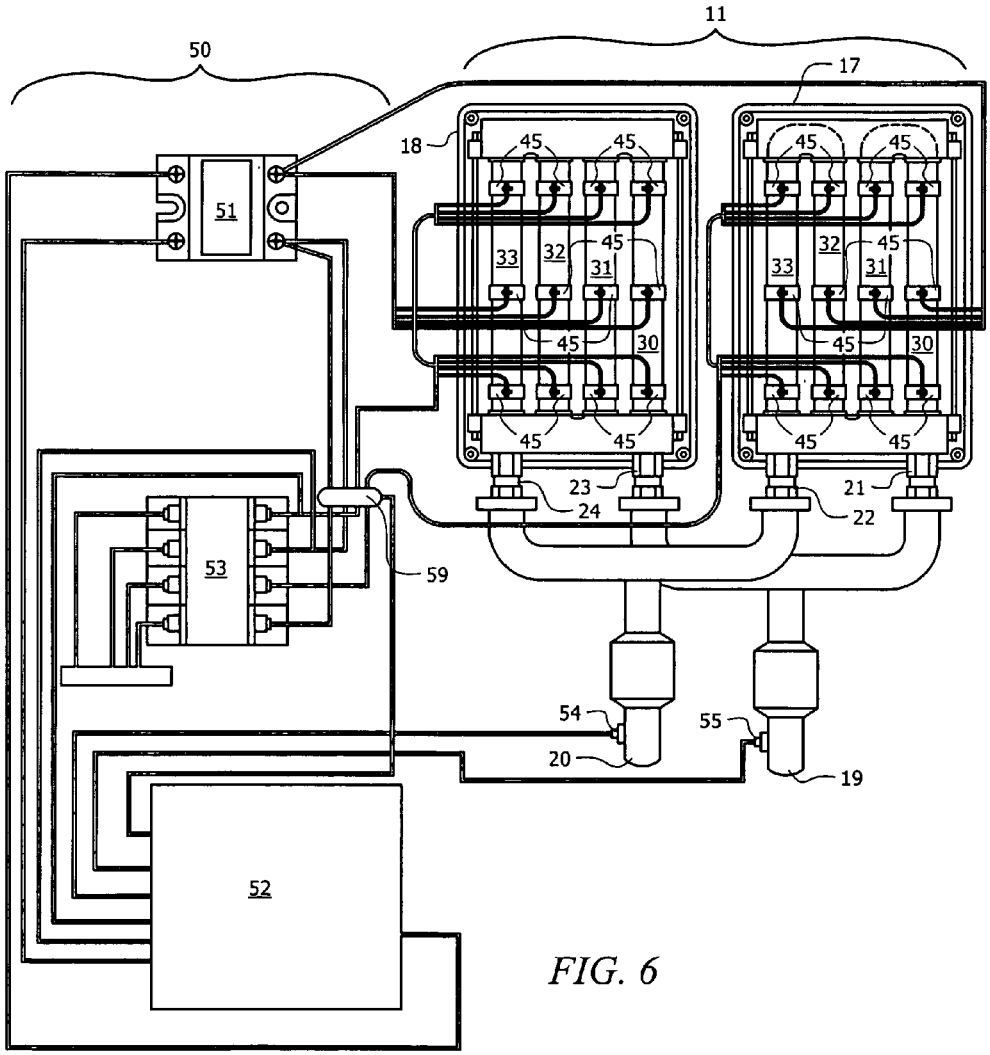
FIG. 6 is a diagram of the control circuit and liquid heating assembly of a tankless liquid heater in accordance with an embodiment of the present invention.

In an embodiment, as shown in FIG. 6, control circuit 50 comprises switch 51, controller 52, and power distributer 53. Temperature is measured by temperature sensor 54 coupled to heating assembly 11 along the outflow portion of the liquid flow path. Liquid flow rate is determined by flow sensor 55 coupled to heating assembly 11 along the liquid flow path. Current leakage is measured by current leakage sensor 59 coupled to the wires disseminating current from power distributer 53. Various types of sensor and sensor placement may used to measure temperature, liquid flow, and current leakage. The temperature and liquid flow sensors may be mounted to heating tubes 30-33, liquid inlets 21, 23, liquid outlets 22,24, primary liquid inlet 19, or primary liquid outlet 20, depending on what is being sensed. In the present embodiment, temperature sensor 54 is located on primary liquid outlet 20 and flow sensor 55 is located on primary liquid inlet 19. The leakage sensor may be mounted along the current flow path.

Temperature sensor 54, flow sensor 55, and current leakage sensor 59 provide data to controller 52, which then actuates switch 51 in response to the received data. Switch 51 may be any device capable of allowing and preventing current flow to the heating elements responsive to input from the controller. In the present embodiment, switch 51 is a solid-state relay.

Controller 52 may have a minimum flow rate setting and temperature setting. Controller 52 will actuate switch 51 to a closed position to allow current to flow from power distributer 53 to heating elements 45, when the flow rate detected by flow rate sensor 55 exceeds the flow rate threshold and the temperature detected by temperature sensor 54 is less than the temperature setting. Controller 52 will actuate switch 51 to an open position to prevent current flow to heating elements 45, when either the flow rate is less than the flow rate threshold or the temperature is greater than or equal to the temperature setting.

Controller 52 may also have a maximum current leakage setting. Controller 52 will actuate switch 51 to an open position when the current leakage detected by current leakage sensor 59 exceeds the maximum current leakage setting.

Figure 7:
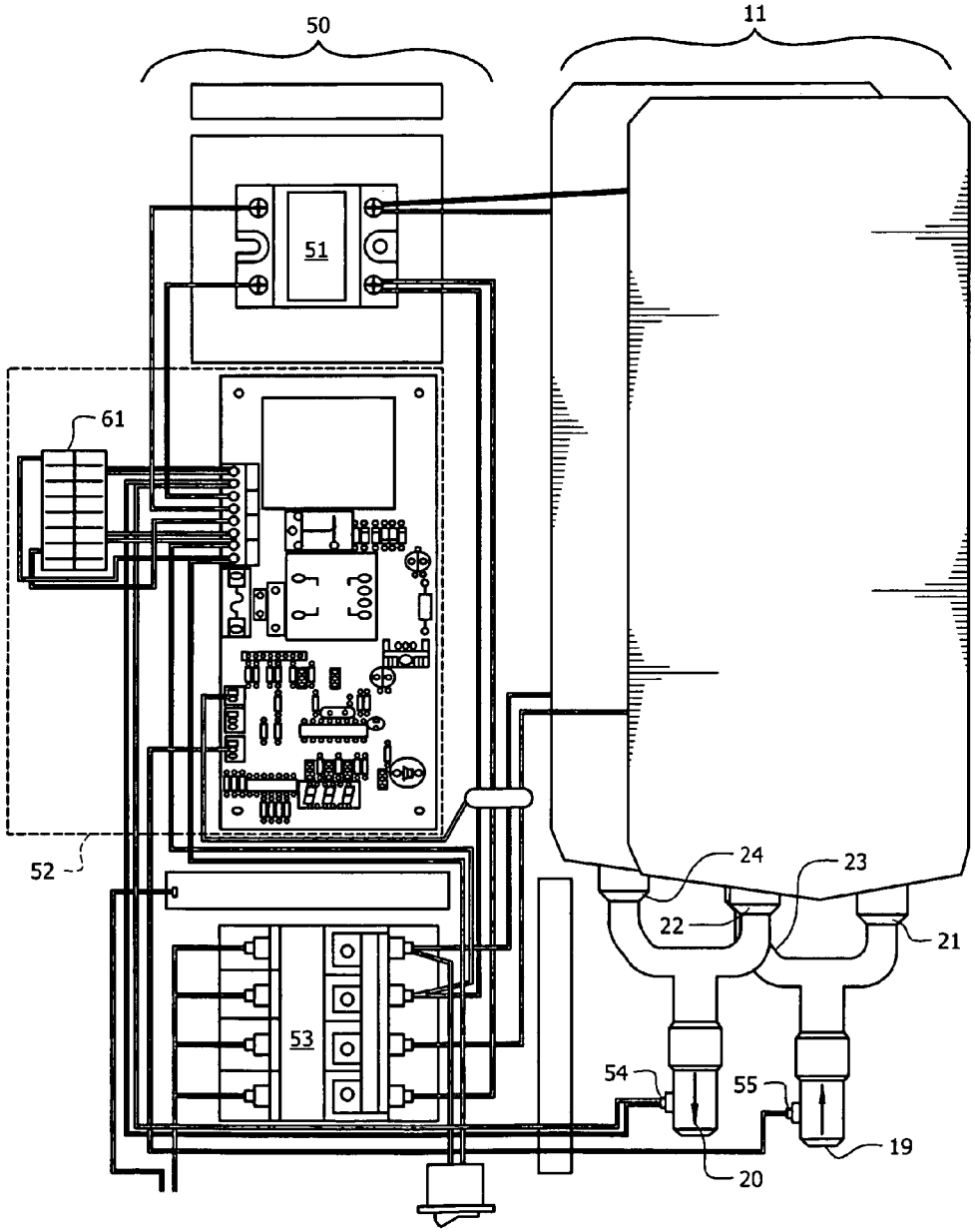
FIG. 7 is a diagram of the control circuit and liquid heating assembly of a tankless liquid heater in accordance with an embodiment of the present invention.

Controller 52 may comprise a general controller that takes temperature and other sensor inputs and uses the inputs to actuate switch 51, as shown in FIG. 6 and described above, or Controller 52 may comprise, as shown in FIG. 7, a general controller 60, and a temperature controller 61. In the embodiment shown in FIG. 7, general controller 60 is a printed circuit board and temperature controller 61 is a PID controller.

Power distributer receives power from a power source (not shown) and supplies power to heating elements 45 as regulated by switch 51.

Figure 8:
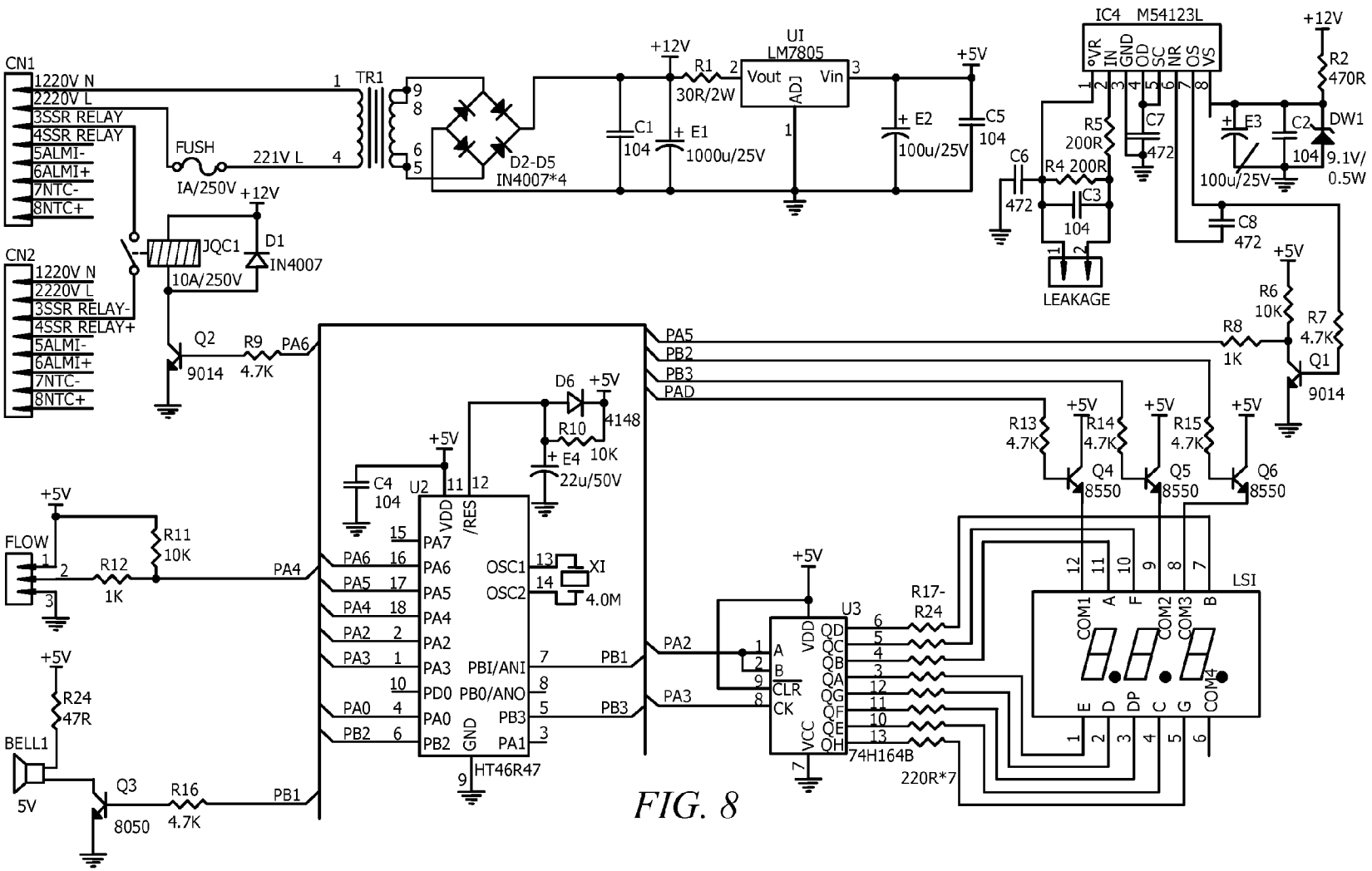
FIG. 8 is an illustrative control circuit diagram for use in an embodiment of the present invention.

FIG. 8 is an illustrative control circuit diagram for use in an embodiment of the present invention.

Figure 9:
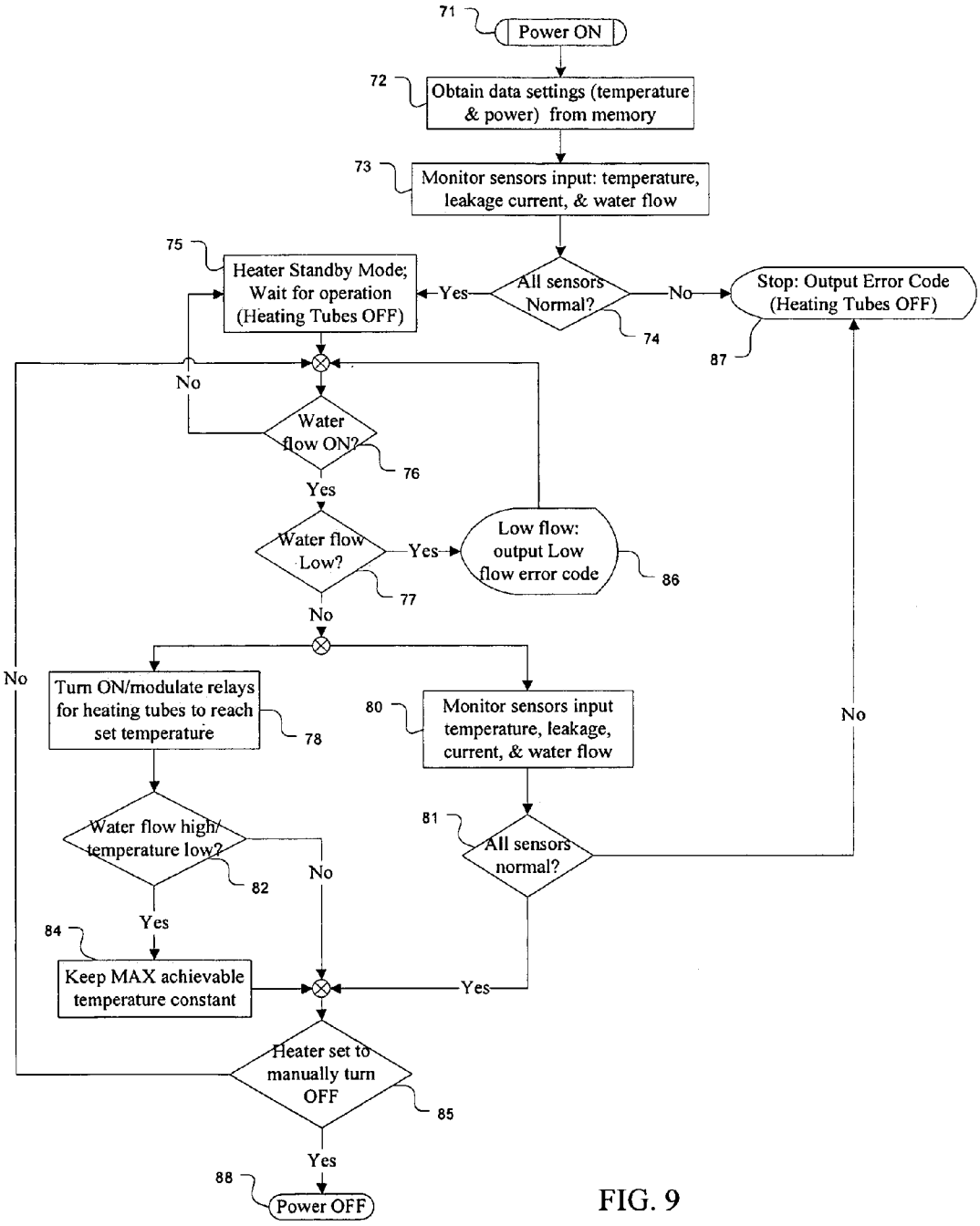
FIG. 9 is a flowchart showing the control logic of a tankless liquid heater in accordance with an embodiment of the present invention.

FIG. 9 provides a high-level flowchart of the system control. After powering on the system is powered on in operation 71, the system moves to operation 72, which includes accessing on board memory to acquire the necessary settings, such as temperature and power settings. In operation 73, the system performs a system check for sensor operability, liquid temperature, leakage current, and liquid flow. If all sensors are functional (operation 74), the heater, in operation 75, enters standby mode (heating tubes are turned off). In operation 76, the system ensures that there is a liquid flow and operation 77 ensures liquid flow is sufficient for operation. In operation 78, responsive to normal operating parameters (e.g. minimal liquid flow=0.5 GPM), the system activates (or turns on) and modulates the switch for the heating tubes to achieve the user-defined temperature. In operations 80, 81, and 82, the system constantly monitors parameters, such as temperature, current leakage, and liquid flow. In operation 82, the system determines if liquid flow is sufficient for operation and if the target temperature has been achieved. If the liquid flow is determined to be sufficient, but the liquid temperature is low, then the system keeps the maximum achievable temperature constant throughout the system in operation 84 until the system is manually turned off (operations 85 and 88)). Responsive to predetermined parameters the system will issue error codes notifying the user of a problem (e.g. low flow error code (operation 86) and/or stop/error code (operation 87). For example, once liquid temperature exceeds 125 degrees, the system automatically shuts down and resumes operation once the temperature of liquid in the system falls below 125 degrees. As another example, once the current leakage reaches 15 mA, the system automatically shuts down.

The liquid heater of a present embodiment provides a more efficient liquid heater than that of the prior art. Each heating tube draws a current of 10 A making each chamber, having four heating tubes, draw 40 A. An embodiment with one chamber, having amperage of 40 A has wattage of 8.8 kW. An embodiment with two chambers, having amperage of 80 A has wattage of 17.6 kW. Tankless liquid heater of the prior art using the same amount of amperage (80 A), draw 5 kW more than the present invention. Example specifications are given in the chart of FIG. 10.

In addition, the liquid heater of a present embodiment is capable of operating with only one working heating tube. If up to three heating tubes stop conducting heat for any reason, the remaining tubes will receive the current not being used by the broken tubes and no interruption will result.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall there between. Now that the invention has been described,

What is claimed is:

1. A tankless water heater, comprising:

at least one straight tube formed of quartz;

at least one heating element mounted in contacting relation to said at least one straight tube so that heat is transferred from said at least one heating element to said at least one straight tube by conduction;

a first end of said at least one straight tube in fluid communication with a source of liquid fluid under pressure;

a second end of said at least one straight tube in fluid communication with a point-of-use outlet;

an elongate insert disposed concentrically within a lumen of said at least one straight tube;

said elongate insert having a diameter less than a diameter of said lumen;

a helical ridge formed in said elongate insert along its extent and extending from said elongate insert by a nominal extent;

said nominal extent being relative to a distance from said elongate insert to an interior wall of said at least one straight tube;

said helical ridge constraining liquid fluid flowing through said at least one straight tube to flow radially outwardly as a turbulent flow into contacting relation to said interior wall of said at least one straight tube, said turbulent flow inhibiting build-up of mineral deposits on said interior wall and said elongate insert;

said tankless water heater heating liquid fluid flowing through said at least one straight tube when said at least one heating element is in electrical communication with a source of electrical power; and said at least one straight tube having a dry external surface.

2. A tankless water heater, comprising:

at least one straight tube formed of quartz;

a first frame for holding a first end of said at least one straight tube;

a second frame for holding a second end of said at least one straight tube;

a liquid inlet formed in said first frame and a liquid outlet formed in said second frame;

an elongate insert disposed concentrically within a lumen of said at least one straight tube;

said elongate insert having a diameter less than a diameter of said lumen;

a helical, radially outwardly extending flange formed along a length of said elongate insert and extending from said elongate insert by a nominal extent;

said nominal extent being relative to a distance from said elongate insert to an interior wall of said at least one straight tube;

at least one annular heating element disposed in contacting, circumscribing relation to said at least one straight tube so that heat transfers by conduction radially inwardly from said at least one annular heating element into a lumen of said at least one straight tube, thereby heating liquid fluid flowing through said at least one straight tube;

said at least one annular heating element being in switched electrical communication with a remote source of electrical power;

a source of unheated liquid fluid under pressure connected in fluid communication with said liquid inlet so that heated liquid fluid flows outwardly from said liquid outlet when said at least one annular heating element is operating;

said insert and said helical, radially outwardly extending flange causing liquid fluid to flow radially outwardly as a turbulent flow into contacting relation with said interior wall of said at least one heated straight tube, said turbulent flow inhibiting build-up of mineral deposits on said interior wall and said elongate insert; and said at least one straight tube having a dry external surface.

3. The tankless heater of claim 2, further comprising:

said at least one annular heating element including a plurality of heating elements;

each of said annular heating elements of said plurality of annular heating elements being in independent electrical communication with said remote source of electrical power so that loss of power to one annular heating element does not affect other heating elements.

4. A tankless water heater, comprising:

a first module for heating water disposed in parallel relation to a second module for heating water;

said first and second modules having first and second inlets, respectively, connected to a common source of unheated water under pressure;

said first and second modules having first and second outlets, respectively, connected to a common outlet of heated water under pressure;

said first module including at least one straight tube formed of quartz, a first frame for holding a first end of said at least one straight tube, and a second frame for holding a second end of said at least one straight tube;

said second module including at least one straight tube formed of quartz, a first frame for holding a first end of said at least one straight tube of said second module, and a second frame for holding a second end of said at least one straight tube of said second module;

a first elongate insert disposed concentrically within a lumen of said at least one straight tube of said first module;

a second elongate insert disposed concentrically within a lumen of said at least one straight tube of said second module;

said first and second elongate inserts having respective diameters less than a diameter of said respective lumens;

a helical, radially outwardly extending flange formed along a length of said first elongate insert of said first module so that liquid fluid is constrained to flow radially outwardly as a turbulent flow into contact with an interior wall of said at least one straight tube of said first module, said turbulent flow inhibiting build-up of mineral deposits on said first elongate insert and said interior wall of said at least one straight tube of said first module;

said flange extending from said first elongate insert by a nominal extent;

said nominal extent being relative to a distance from said first elongate insert to said interior wall of said at least one straight tube of said first module;

a helical, radially outwardly extending flange formed along a length of said second elongate insert of said second module so that liquid fluid is constrained to flow radially outwardly as a turbulent flow into contact with the walls of said at least one straight tube of said second module, said turbulent flow inhibiting build-up of mineral deposits on said second elongate insert and said interior wall of said at least one straight tube of said second module;

said flange extending from said second elongate insert by a nominal extent;

said nominal extent being relative to a distance from said second elongate insert to said interior wall of said at least one straight tube of said second module;

at least one annular heating element disposed in contacting, circumscribing relation to said at least one straight tube of said first module so that heat transfers by conduction radially inwardly from said at least one annular heating element into said at least one straight tube, thereby heating said at least one straight tube;

at least one annular heating element disposed in contacting, circumscribing relation to said at least one straight tube of said second module so that heat transfers by conduction radially inwardly from said at least one annular heating element into said at least one straight tube of said second module, thereby heating said at least one straight tube of said second module;

said at least one heating element of said first module being in switched electrical communication with a remote source of electrical power;

said at least one heating element of said second module being in switched electrical communication with said remote source of electrical power;

said annular heating elements of said first and second modules being dry; and said parallel connection of said first and second modules providing water to said common point-of-use outlet at a temperature equal to that of a single module but at an increased volume.

5. The tankless heater of claim 4, further comprising:

said at least one annular heating element including a plurality of heating elements;

each of said annular heating elements of said plurality of annular heating elements being in independent electrical communication with said remote source of electrical power so that loss of power to one annular heating element does not affect other heating elements.

6. A tankless water heater, comprising:

a first module for heating water disposed in series relation to a second module for heating water;

said first module having an inlet connected to a source of unheated water under pressure;

said first module having an outlet connected to an inlet of said second module;

said second module having an outlet connected to a point-of-use outlet for heated water under pressure;

said first module including at least one straight tube formed of quartz, a first frame for holding a first end of said at least one straight tube, and a second frame for holding a second end of said at least one straight tube;

said second module including at least one straight tube formed of quartz, a first frame for holding a first end of said at least one straight tube of said second module, and a second frame for holding a second end of said at least one straight tube of said second module;

a first elongate insert disposed concentrically within a lumen of said at least one straight tube of said first module;

a second elongate insert disposed concentrically within a lumen of said at least one straight tube of said second module;

said first and second elongate inserts having respective diameters less than a diameter of said respective lumens;

a helical, radially outwardly extending flange formed along a length of said first elongate insert of said first module so that liquid fluid is constrained to flow radially outwardly as a turbulent flow into contact with an interior wall of said at least one straight tube of said first module, said turbulent flow inhibiting build-up of mineral deposits on said first elongate insert and said interior wall of said at least one straight tube of said first module;

said flange extending from said first elongate insert by a nominal extent;

said nominal extent being relative to a distance from said first elongate insert to said interior wall of said at least one straight tube of said first module;

a helical, radially outwardly extending flange formed along a length of said second elongate insert of said second module so that liquid fluid is constrained to flow radially outwardly as a turbulent flow into contact with the walls of said at least one straight tube of said second module, said turbulent flow inhibiting build-up of mineral deposits on said second elongate insert and said interior wall of said at least one straight tube of said second module;

said flange extending from said second elongate insert by a nominal extent;

said nominal extent being relative to a distance from said second elongate insert to said interior wall of said at least one straight tube of said second module;

at least one annular heating element disposed in contacting, circumscribing relation to said at least one straight tube of said first module so that heat transfers by conduction radially inwardly from said at least one annular heating element into said at least one straight tube of said first module, thereby heating said at least one straight tube of said first module;

at least one annular heating element disposed in contacting, circumscribing relation to said at least one straight tube of said second module so that heat transfers by conduction radially inwardly from said at least one annular heating element into said at least one straight tube of said second module, thereby heating said at least one straight tube of said second module;

said at least one heating element of said first module being in switched electrical communication with a remote source of electrical power;

said at least one heating element of said second module being in switched electrical communication with said remote source of electrical power;

annular heating elements of said first and second modules being dry; and said series connection of said first and second modules providing water to said common point-of-use outlet in a volume equal to that of a single module but at an elevated temperature.

7. The tankless heater of claim 6, further comprising:

said at least one annular heating element including a plurality of heating elements;

each of said annular heating elements of said plurality of annular heating elements being in independent electrical communication with said remote source of electrical power so that loss of power to one annular heating element does not affect other heating elements.

8. A tankless water heater, comprising:

a pair of straight tubes disposed in spaced apart, parallel relation to one another;

each tube of said pair of tubes formed of quartz;

a first frame for holding respective leading ends of said pair of straight tubes;

a second frame for holding respective trailing ends of said pair of straight tubes;

a liquid inlet formed in a first end of said first frame and a liquid outlet formed in a second end of said first frame;

a curved tube having a return bend formed therein connecting said respective trailing ends of said straight tubes to one another so that liquid fluid flowing through said pair of straight tubes is constrained to reverse flow direction;

said curved tube being mounted to said second frame;

a first elongate insert disposed concentrically within a lumen of a first straight tube of said pair of straight tubes;

a second elongate insert disposed concentrically within a lumen of a second straight tube of said pair of straight tubes;

said first and second elongate inserts having respective diameters less than a diameter of said lumens of said first and second straight tubes;

first and second helical, radially outwardly extending flanges formed along a length of each first and second elongate insert, respectively;

said first and second flanges extending from said first and second elongate inserts, respectively, by a nominal extent;

said nominal extent being relative to a distance from said first and second elongate inserts to respective interior walls of said at least one straight tube of said first and second modules, respectively;

at least one annular heating element disposed in contacting, circumscribing relation to each straight tube of said pair of straight tubes so that heat transfers by conduction radially inwardly from said at least one annular heating element into said straight tubes, thereby heating said straight tubes;

said at least one annular heating element being in switched electrical communication with a remote source of electrical power;

a source of unheated liquid fluid under pressure connected in fluid communication with said liquid inlet so that heated liquid fluid flows outwardly from said liquid outlet when said at least one annular heating element is operating;

each first and second elongate insert and each first and second helical, radially outwardly extending flange causing liquid fluid to flow radially outwardly as a turbulent flow into contacting relation with each straight tube of said pair of heated straight tubes, said turbulent flow inhibiting build-up of mineral deposits on said first and second elongate inserts and respective interior walls of each straight tube of said pair of straight tubes; and said annular heating elements being dry.

9. The tankless heater of claim 8, further comprising:

said at least one annular heating element including a plurality of heating elements;

each of said annular heating elements of said plurality of annular heating elements being in independent electrical communication with said remote source of electrical power so that loss of power to one annular heating element does not affect other heating elements.

* * * * *